US007165689B2

(12) United States Patent
McDaniel

(10) Patent No.: US 7,165,689 B2
(45) Date of Patent: Jan. 23, 2007

(54) RACK AND ORGANIZER

(76) Inventor: Cammie McDaniel, 1931 S. Clark St., Unit B, Chicago, IL (US) 60616

( * ) Notice: Subject to any disclaimer, the term of this patent is extended or adjusted under 35 U.S.C. 154(b) by 148 days.

(21) Appl. No.: 10/795,886

(22) Filed: Mar. 8, 2004

(65) Prior Publication Data

US 2005/0194337 A1 Sep. 8, 2005

(51) Int. Cl.
*A47F 7/19* (2006.01)

(52) U.S. Cl. ..... 211/165; 211/85.3; 211/116; 211/197; 223/91

(58) Field of Classification Search ..... 211/165, 211/105, 85.3, 167, 163, 96, 116, 5–8, 1.3, 211/110, 85.24, 197; 70/62; 223/88–91, 223/120

See application file for complete search history.

(56) References Cited

U.S. PATENT DOCUMENTS 1,236,212 A * 8/1917 Saladee ..... 211/1.3
1,476,667 A * 12/1923 Wood ..... 211/165
1,587,676 A * 6/1926 Patterson ..... 211/1.3
2,469,494 A * 5/1949 Bushko ..... 211/172
3,964,611 A * 6/1976 Galen et al. ..... 211/5
5,022,617 A * 6/1991 Henderson ..... 248/125.8
5,901,888 A * 5/1999 Schneider et al. ..... 223/89
6,702,129 B1 * 3/2004 Harris ..... 211/196

OTHER PUBLICATIONS

Article, "Multi-Hanger" (Hemden & Kleiderhänger), *Reicorp® Co., Ltd., Hong Kong*, date unknown.

* cited by examiner

*Primary Examiner*—Richard E. Chilcot, Jr.
*Assistant Examiner*—Jared W. Newton
(74) *Attorney, Agent, or Firm*—Fitch, Even, Tabin & Flannery

(57) ABSTRACT

A storage apparatus is disclosed having a central post capable of rotating and having a plurality of extensions pivotably attached thereto for receiving items. The extensions may pivot between a position for displaying, selecting, or attaching items and a position for compactly storing the items. The items may be clothing, and the items may be secured by hooks, clamps, or the like.

1 Claim, 8 Drawing Sheets

RACK AND ORGANIZER

FIELD OF THE INVENTION

The invention relates to storage and, in particular, to a rack and organizer for items such as clothing.

BACKGROUND OF THE INVENTION

Currently, the most typical places for people to store their clothing and apparel items are in closets, drawers, and bins. Most people prefer to have as many items as possible visible on a quick glance and easily removable. A problem common for many people is having more clothing than can be accommodated by the storage space in their home or abode.

A number of solutions are currently employed for dealing with clothing volume that exceeds storage space that provides for quick and simple access to items. For instance, some people use a basement closet or other remote closet for placing items that are used less often. In some cases, people will simply put their out-of-season wardrobes in a box or storage container that is put under a bed or other not-easily accessed storage space.

It is usually most convenient to store items in the closet of a room adjacent to a bedroom so that items are quickly retrieved and swapping wardrobes from one closet to a bedroom closet is a minimal task. However, a spare closet is often fully utilized as well, or simply not available. In some cases, a person may devote floor space and have a free-standing closet or other furniture item, or a free standing clothing bar.

Free-standing closets and clothing bars require a certain amount of floor space. Free-standing closets only provide for space for clothing on a single bar or on two bars where one is positioned above the other. Free-standing clothing bars may provide one or more bars, but they are often positioned beside each other so that one has to have access to both sides of the apparatus to reach the clothing.

Accordingly, there has been a need for a new and improved clothing rack and organizer that provides storage space for a large amount of clothing while minimizing the amount of space required for the clothing and itself.

SUMMARY OF THE INVENTION

In accordance with one aspect of the present invention, an apparatus for storing items is disclosed including a support, a base rigidly connected to the support, and a plurality of extensions having a pivot end and a securable end and including attachment members for receiving items, wherein the extensions may pivotably be moved between a first position where the securable end of the extension is generally disposed a first distance from the support and a second position where the securable end is generally disposed a greater distance from the support. In one form, the apparatus is a clothing rack and organizer apparatus. The support may be a central post which can receive clothing for storage in a plurality of orientations to the central post. The apparatus may include a number of extensions from the central post oriented in a plurality of positions, and clothing may be secured thereon for storage. The extensions may be positioned relative to each other in lateral directions around the post, in vertical directions along the length of the post, or a combination of both.

In accordance with another aspect of the present invention, the extensions may actively or passively secure clothing or other items thereon. In one form, the extensions may be provided with a clamping device which can be operated to actively secure the clothing therein. In another form, the extensions may provide features on which the clothing or other items are secured.

In accordance with a further aspect of the present invention, a generally stationary person may view all the clothing or other items secured on the apparatus. In one form, the central post is provided with a base permitting the apparatus to rotate around itself. The apparatus may be provided with grips for manual rotation of the apparatus. In another form, the extensions may be operable to move from a storage position to a display position such that the space required by the apparatus with clothing thereon is minimized when the extensions are in the storage position and such that the clothing or stored items may be examined and identified when the extensions are in the display position.

DESCRIPTION OF THE PREFERRED EMBODIMENTS

Figure 1:
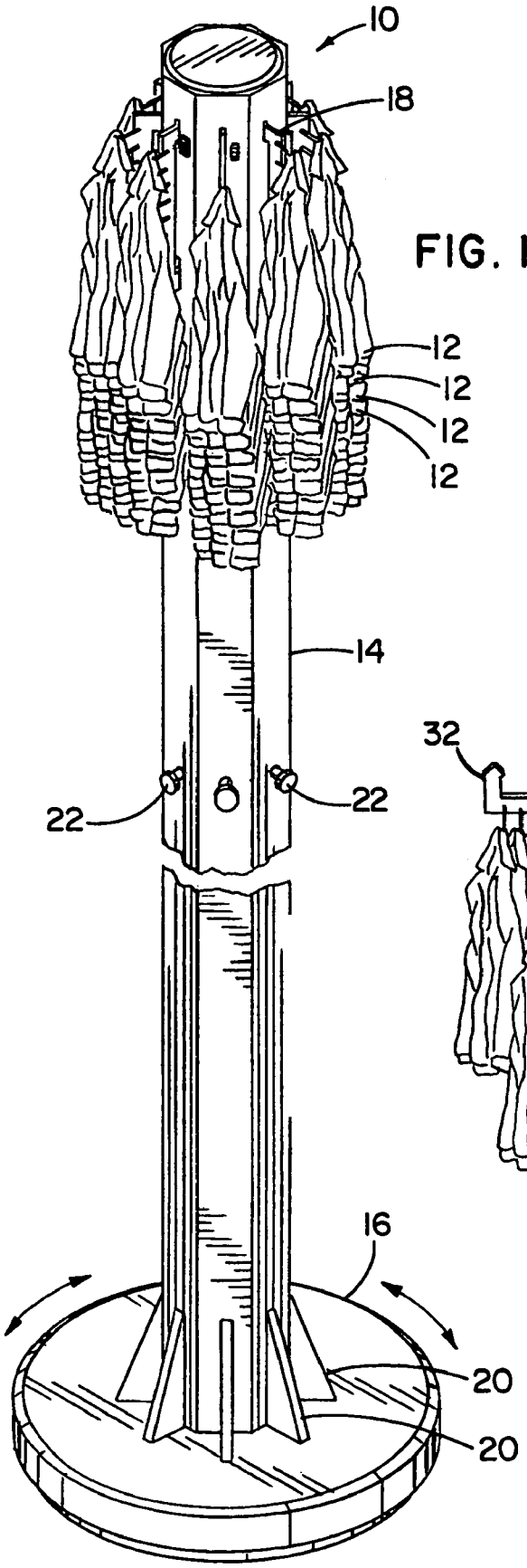
FIG. 1 is a perspective view of an embodiment of a storage apparatus including extensions in a storage configuration with storage items secured thereon and including features of the present invention.
Figure 2:
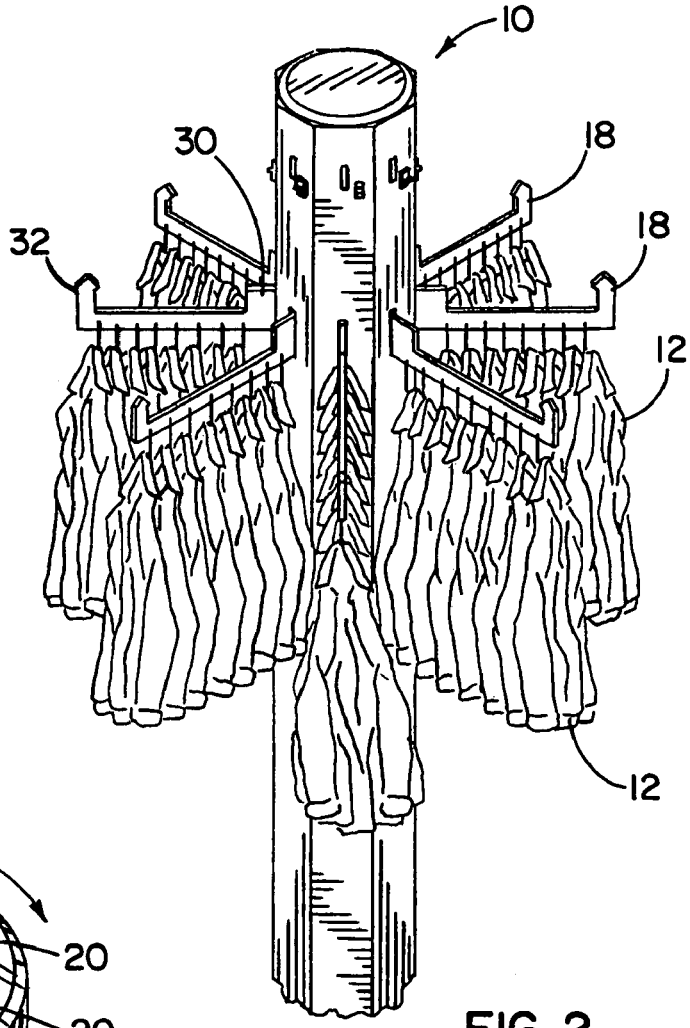
FIG. 2 is a partial perspective view of the storage apparatus of FIG. 1 with the extensions in a display configuration.

Referring initially to FIG. 1, an storage apparatus 10 is depicted with storage items 12 stored thereon. Though a number of kinds of items may be stored with the present apparatus, in the present embodiment the items 12 are clothing such as shirts, pants, and the like. The storage apparatus 10 includes a support in the form of a central post 14, a base 16, and a plurality of pivotable extensions 18 for receiving the items 12 and located on the post 14. As depicted, the post 14 is octagonal with a plurality of faces located around a central axis of rotation 15, though the post 14 may have any number of sides, one or more of which may include an extension 18. In addition, the post 14 may be cylindrical with a circular cross-section and having a plurality of extensions thereon. Preferably, the number and location of the extensions 18 is selected so that storage items 12 thereon do not cause an imbalance or undue stresses between the post 14 and the base 16.

The post 14 is generally vertically aligned and secured at its bottom to the base 16. In order to provide strength and rigidity between the post 14 and base 16, a plurality of buttresses 20 are secured to the base 16 and post 14 and extending therebetween. The buttresses 20 are preferably located around the periphery of the post 14 so that support is provided in a plurality of directions.

The base 16 permits rotation of the post 14 around its central longitudinal axis without translating across a support surface, such as with a lazy susan or turntable pedestal. Alternatively, the base 16 may include wheels located thereunder for rotating against the ground surface on which the apparatus 10 is set. Located on the post 14 may be one or more knobs 22 permitting the user to rotate the apparatus. As a user gripping the knobs 22 may inadvertently apply lateral pressure on the post 14, which adds stresses to the junction between the buttresses 20, post 14, and base 16, the base 16 may be included with a mechanism (not shown) for providing rotation to the apparatus 10. The mechanism may be one or more foot pedals, for instance, that may be operated to the mechanism for rotating the apparatus 10, or may be a electric motor operated by a switch (not shown). The switch may be located at a convenient place for manual operation or for operation with a foot.

Figure 3:
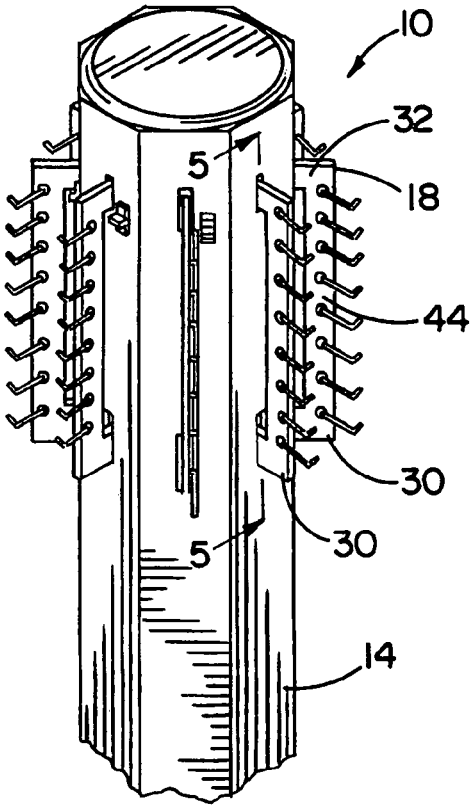
FIG. 3 is a partial perspective view of the storage apparatus of FIG. 1 including extensions in a storage configuration.
Figure 4:
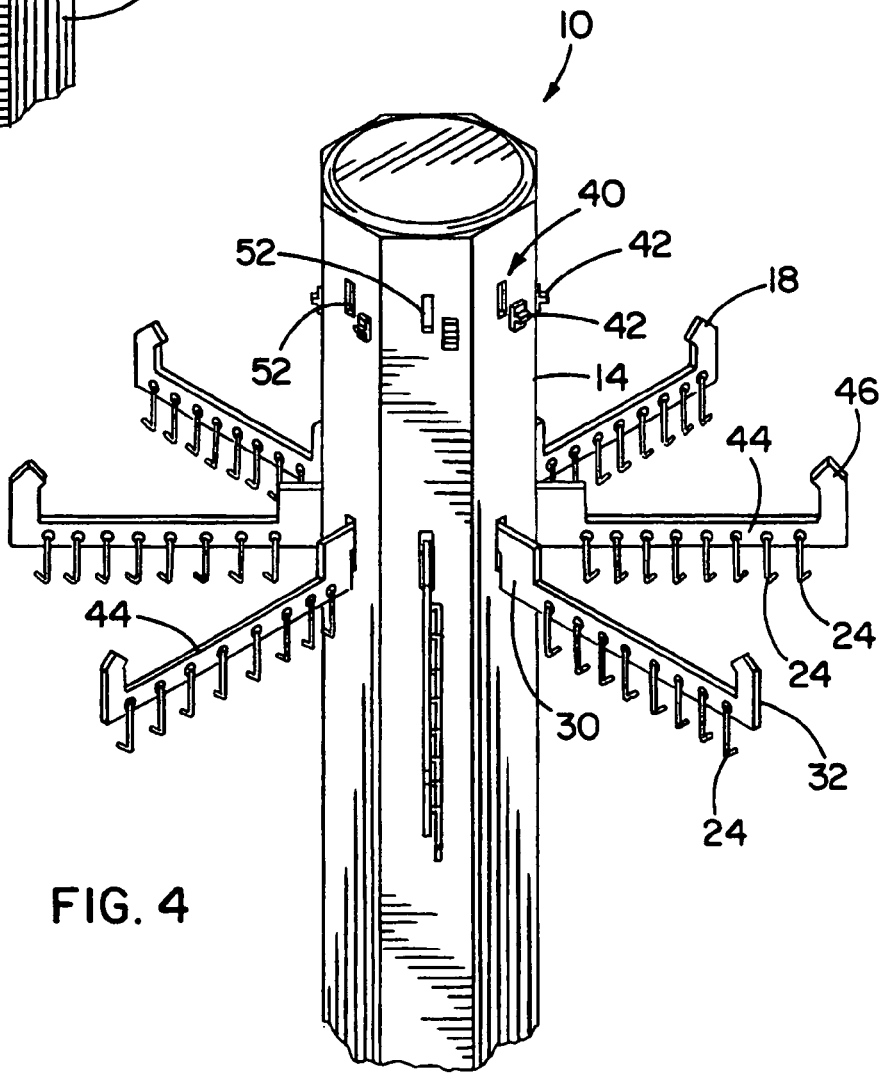
FIG. 4 is a partial perspective view of the storage apparatus of FIG. 4 including extensions in a display configuration.
Figure 5:
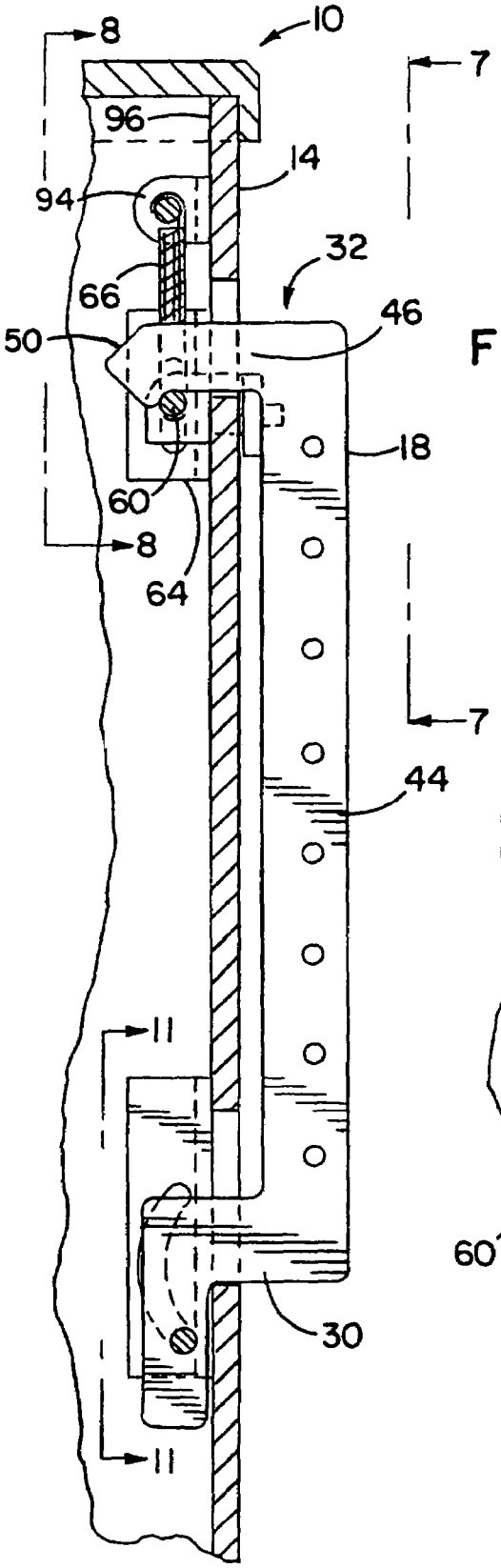
FIG. 5 is a partial cut-away side elevation view taken along the line 5—5 of FIG. 3.
Figure 7:
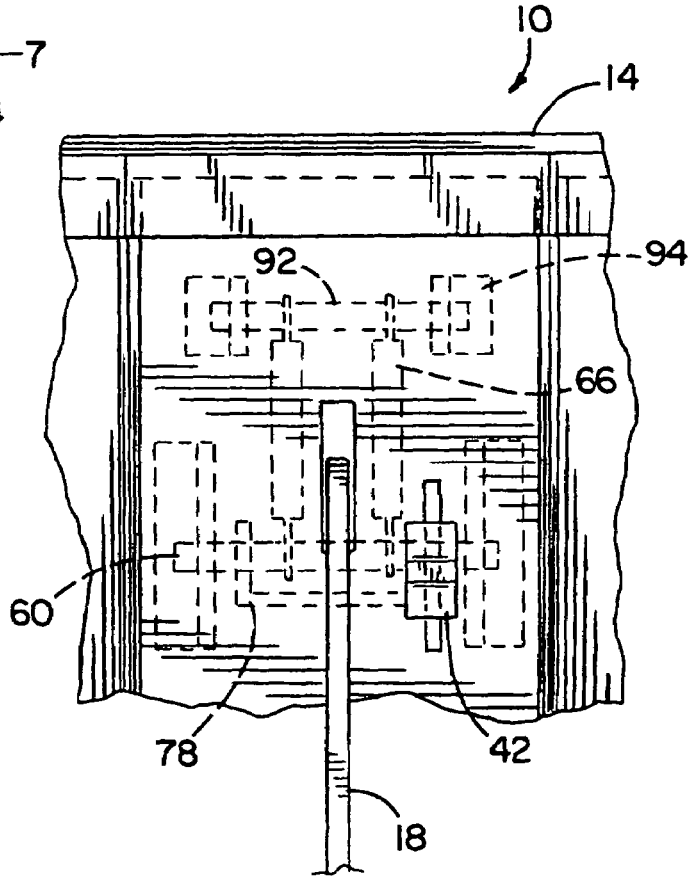
FIG. 7 is a partial front elevation view taken along the line 7—7 of FIG. 5.
Figure 6:
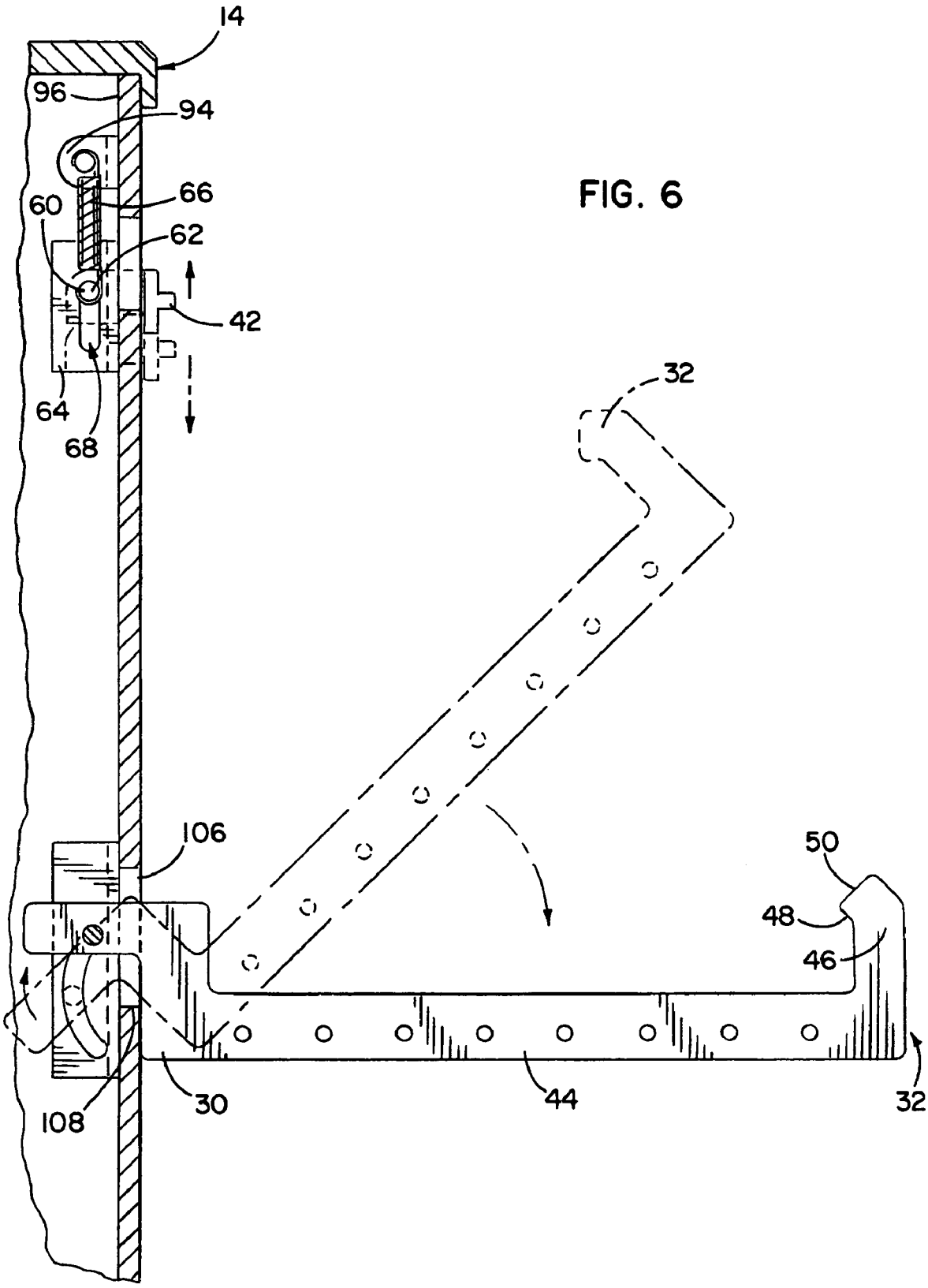
FIG. 6 is a partial cut-away side elevation view of the extension of FIG. 5 an extension in a display configuration.
Figure 8:
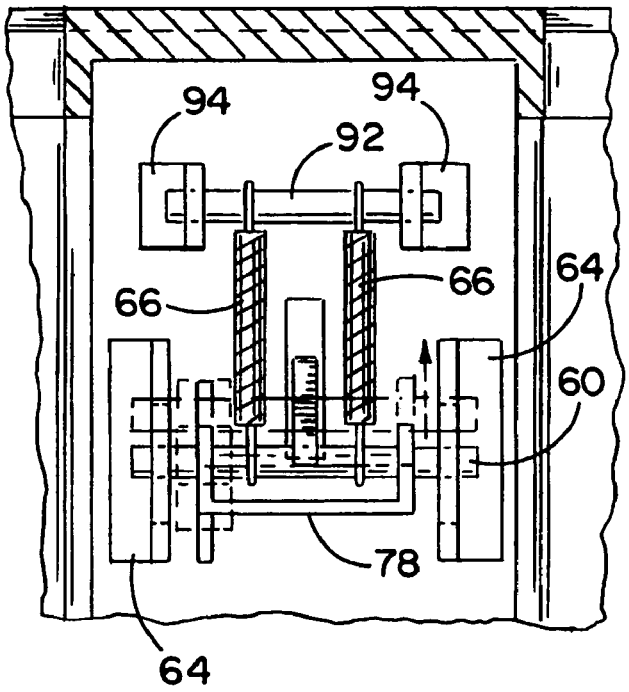
FIG. 8 is a partial rear elevation view of a latch mechanism of the interior of the apparatus of FIG. 1.

In FIG. 1, the extensions 18 are each shown in a storage configuration with items 12 secured thereon. The extensions 18 can be moved from the storage configuration of FIG. 1 to a display configuration depicted in FIG. 2 so that the items may be selectively inspected, selected for removal from the extensions 18, or secured to the extensions 18. FIG. 3 depicts the extensions 18 in a storage configuration without items 12 secured thereon, and FIG. 4 depicts the extensions 18 in a display configuration without items 12 secured thereon. As can be seen in FIG. 1–4, each extension 18 is pivotable around a pivot end 30, and each extension 18 is securable to the post 14 at an opposite, securable end 32.

The post 14 includes a securing mechanism in the form of a latch 40 for each pivotable extension 18. When the extension 18 is moved to and secured in the storage configuration, the securable end 32, and therefore the extension, is secured to the post 14 by the latch 40. Preferably, a user may selectively release the extensions 18 from their respective latch 40 manually, such as by latch release 42. When a latch 40 is released, the user may then lower a corresponding extension 18 manually while supporting the weight of the items 12 thereon. Alternatively, the pivot end 30 may include a damper mechanism (not shown), such as a small hydraulic pump, for slowly lowering the extension 18 without allowing gravity solely to act upon the extension 18 and the items thereon. As can be seen, each extension 18 includes a plurality of item attachment members 24 for securing items thereon, as will be described below.

Each extension 18 includes a generally elongate attachment support 44 spanning between the securable end 32 and the pivot end 30. The securable end 32 includes an arm 46 extending orthogonally and transversely to and from the attachment support 44. In the display configuration of FIGS. 2 and 4, the attachment support 44 is positioned generally horizontally, and the arm 46 extends generally vertically from the attachment support 44. The arm 46 includes a latch catch 48 for securing to the latch 40, as will be discussed below, and a latch plate surface 50 for deflecting the latch 40 to permit the latch catch 48 to secure with the latch 40.

Referring now to FIGS. 5–9, the cooperation between the latch 40 and the securable end 32 is depicted. The post 14 includes a latch opening 52 for receiving each arm 46 and providing access to the latch 40. As the arm 46 is inserted into the latch opening 52 and into the latch 40, the latch plate surface 50 contacts and shifts a deflectable latch bar 60 downward until the latch catch 48 is beyond the latch bar 60, whereupon the latch bar 60 resiliently moves upward so that the latch catch 48 hooks to the latch bar 60 and is prevented from escaping the latch 40 and latch opening 52. In order to release the latch catch 48 from the latch bar 60, the latch release 42 is operated to direct the latch bar 60 downward, thereby permitting the latch catch 48 to pass above the latch bar 60 and out of the latch opening 52.

The latch bar 60 is slidingly received in a pair of guides 64 located at two ends 62 of the latch bar 60. The guides 64 allow the latch bar 60 to reciprocate vertically as required by the operation of the latch 40 and latch release 42 while retaining the latch bar 60 in the proper orientation and in the proper placement for the latch plate surface 50 to contact when the arm 46 is inserted within the latch 40. More specifically, the latch bar 60 is resiliently operated, and such resilience is provided by a pair of springs 66 which pull the latch bar 60 up to meet the arm 46 and latch catch 48 to secure the arm 46 therein. When the arm 46 is not inserted in the latch 40, the bias of the springs 66 is restricted by the guides 64. The guides 64 each have a track 68 for receiving an end 62 of the latch bar 60 therein. The track 68 includes a top end 76 against which the travel of the latch bar 60 is stopped. The latch release 42 is mounted to a release bracket 78 that includes a pair of throughbores 80 for receiving the latch bar 60 therein. When the latch release 42 is depressed, the release bracket 78 forces the latch bar 60 downward against the springs 66. The springs 66 have a shifting end 88 secured to the latch bar 60 and a secure end 90 secured to a mount bar 92. The mount bar 92 is secured in a mount bracket 94 that is, in turn, affixed to an interior surface 96 of the post 14 so that the mount bar 92, and hence the spring secure end 90, is prevented from moving in the vertical direction. It should be noted that the latch mechanism could be a variety of devices or embodiments, or variants of that depicted herein. It should also be noted that the parallel structure (i.e., a pair of springs 66, a pair of guides 64, etc.) is provided to minimize twisting of the components so that forces and motion on and by the latch 40 components is restricted to being generally linear.

Figure 10:
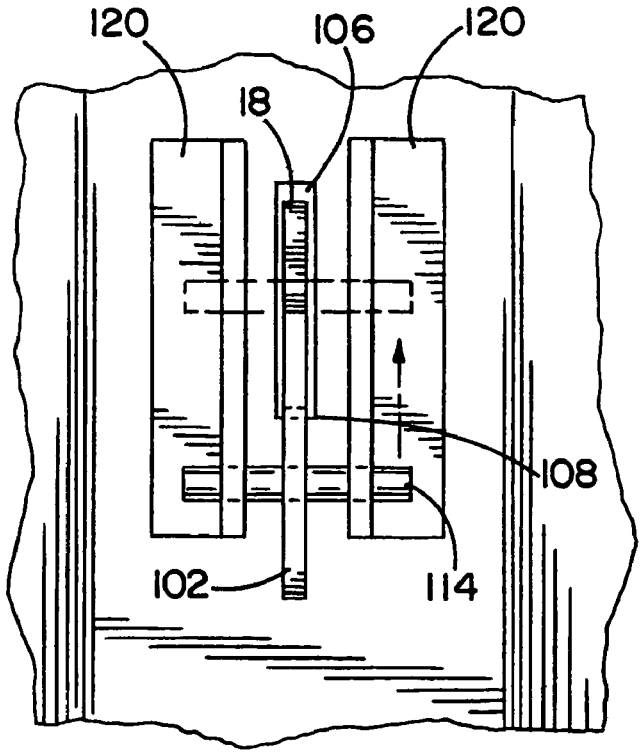
FIG. 10 is a partial rear elevation view of a pivot mechanism of the interior of the apparatus of FIG. 1.
Figure 9:
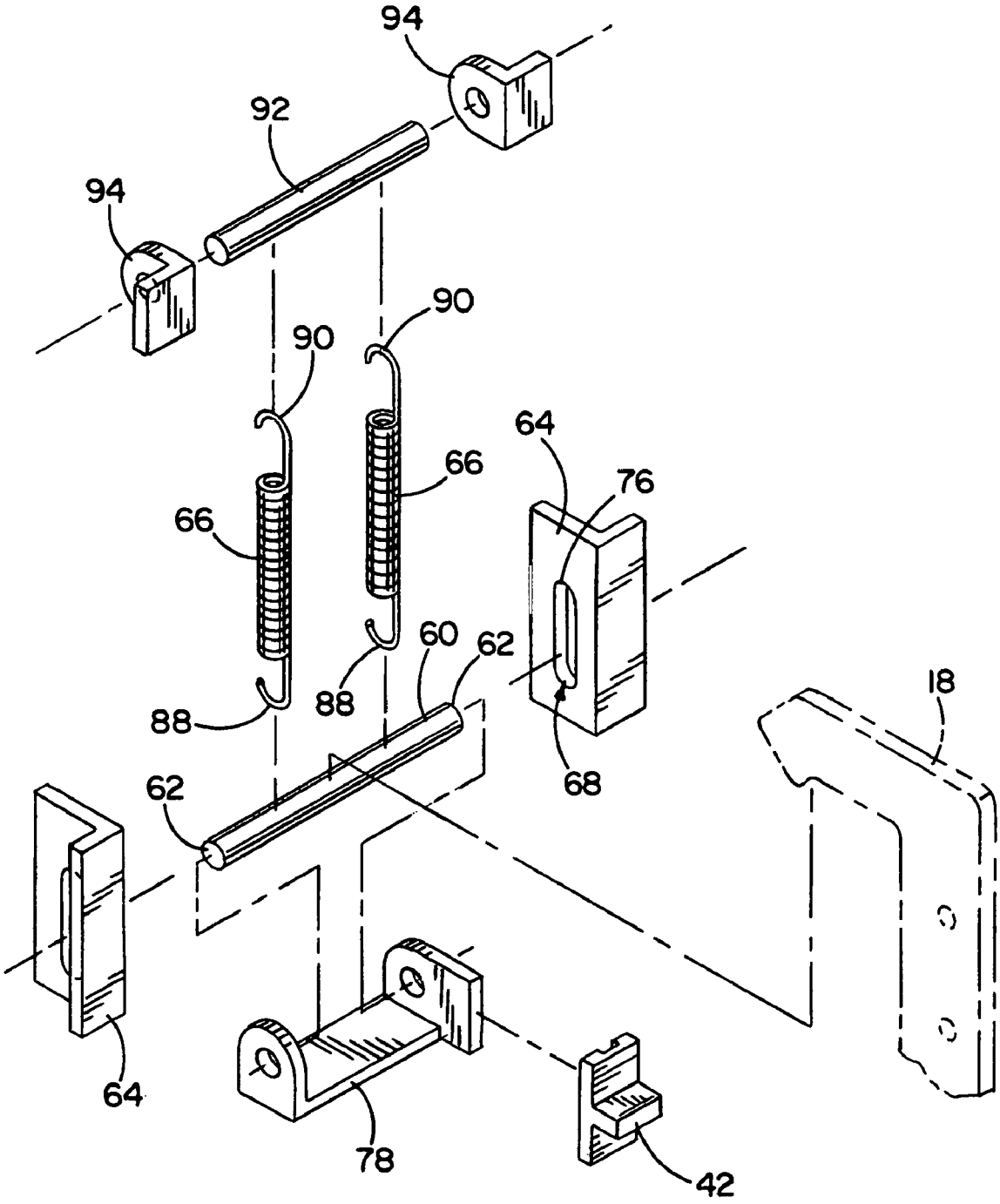
FIG. 9 is an exploded perspective view of the latch mechanism of FIG. 8.
Figure 11:
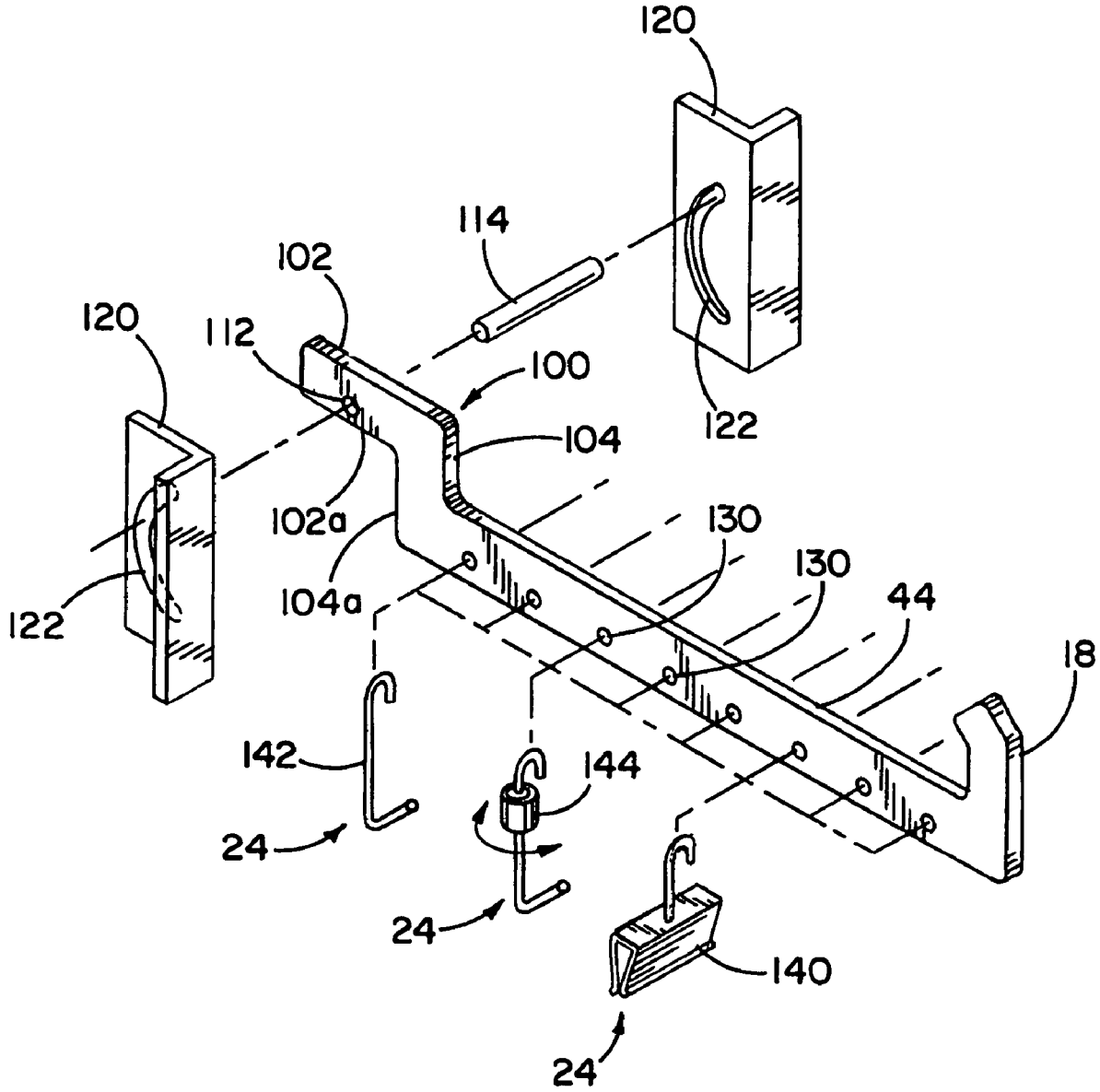
FIG. 11 is an exploded perspective view of an extension and the pivot mechanism of FIG. 10.

As noted above, the extension 18 has a pivot end 30. Referring now to FIGS. 10–11, the pivot end 30 is formed by a pivot bracket 100, a portion of which is located within the interior of the post 14 (see FIG. 4). The pivot bracket 100 includes pivot support 102 and pivot step 104. The pivot bracket 100 passes through a pivot opening 106 in the side of the post 14. When the extension 18 is in the display configuration, the pivot support 102 is supported on a support edge 108 of the pivot opening 106 by an edge 102*a*, and when in the storage configuration the top edge 108 supports an edge 104*a* of the pivot step 104. The pivot support 102 includes a throughbore 112 for receiving a pivot pin 114 that guides the pivot motion of the extension 18 when the extension 18 is moved between the storage and display configurations. In addition, the pivot pin 114 retains the extension 18 from exiting the pivot opening 106. The pivot pin 114 is retained in a pair of pivot guides 120 including arcuate rails 122 for receiving and defining the path of the pivot pin 114. The pivot guides 120 are affixed to the interior of the post 14.

As illustrated in FIG. 11, the attachment members 24 are attached to the attachment support 44. In the present embodiment, by way of example, the attachment support 44 includes bores 130 for receiving attachment members 24 depending therefrom. Preferably, the attachment members 24 are pivotally attached to the attachment support 44 so that the attachment members 24 can hang in a generally vertical alignment regardless of whether the extension 18 is in the storage configuration or the display configuration.

The attachment members 24 can be in a number of forms. For instance, the attachment member 24 can be an active attachment member in the form of a clamp 140. Alternative, and preferably, the attachment member 24 can be in the form of a hook 142. Most preferably, the attachment member 24 can include a rotationally pivoting member 144. It should be noted that any attachment that is capable of securing a storage item 12 may be utilized, including a recess formed directly on the extension 18 for receiving a portion of the item 12 such as a tag on a shirt. It should be noted that the number of attachment members 24 provided on each extension 18 may be selected as to be any number suitably supported by the apparatus 10. It should also be noted that the apparatus 10 may utilized a combination of attachment members 24 that may include clamps 140, hooks 142, pivoting members 144, or any other type of attachment member 24.

Figure 12:
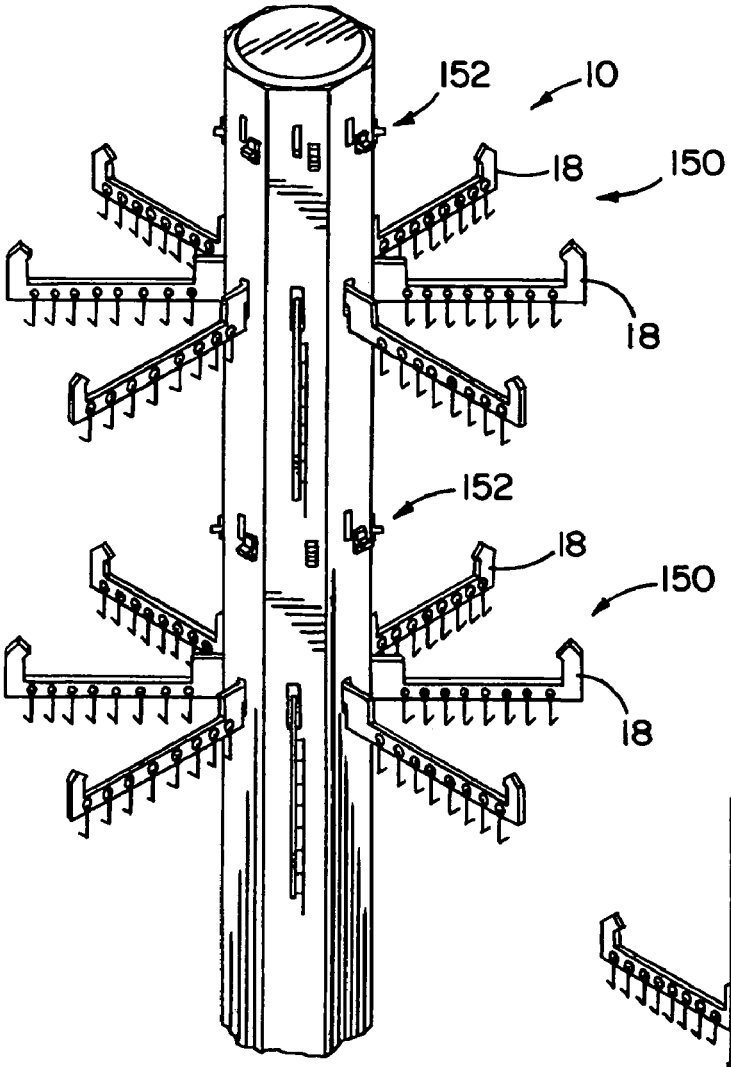
FIG. 12 is a partial view of a second embodiment of a storage apparatus including features of the present invention.
Figure 13:
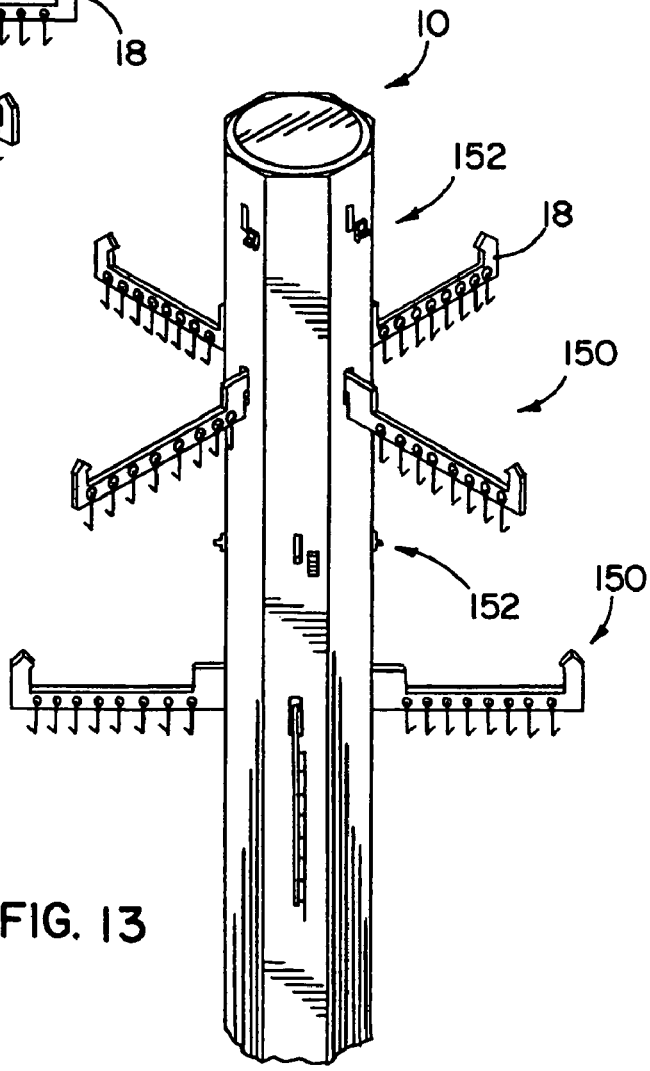
FIG. 13 is a partial view of a third embodiment of a storage apparatus including features of the present invention.

Referring now to FIGS. 12–13, a variety of embodiments and variants are depicted. For instance, the post 14 may be equipped with a plurality of radially extending extension sets 150, each having a latch release set 152, as seen in FIG. 12. Additionally, the extensions 18 from each set 150 may be staggered, as is depicted in as seen in FIG. 13. It should be noted that any arrangement of extensions 18 or extension sets 150 is contemplated.

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

What is claimed is:

1. A clothing rack for organizing and storing clothing comprising:

a base;

a post supported on the base;

a plurality of latch mechanisms each disposed within a corresponding opening in the post, wherein each latch mechanism includes a resilient latch mechanism comprising: a horizontally extending rod adapted for vertical displacement, a fixed bracket disposed vertically above said rod, a resilient pair of springs each having a first end attached to the fixed bracket and a second end attached to said rod, and at least one guide track, wherein the horizontally extending rod is slidingly received in the at least one guide track; and a plurality of extending arms pivotally connected to the post and comprising a plurality of attachment members; each of said arms movable between a first substantially horizontal position to provide access to clothing items stored thereon and a second substantially vertical position to provide a compact arrangement to minimize the space required for storing and organizing the clothing, each arm including a securable upturned distal end adapted to be inserted into an opening in the post and secured thereto by one of said latch mechanisms when the arm is in the compact arrangement to provide support for the clothing items;

wherein each of said upturned distal ends urges a respective horizontal rod in a downward direction when said arms transition between said first and second positions, and each resilient pair of springs urges said rod upward to engage the distal end of a respective arm and maintain said arm in said second position; and a plurality of latch release mechanisms, wherein each latch release mechanism is attached to a latch release bracket, and wherein each latch release bracket is attached to a respective one of said horizontally extending rods so that when one of said latch release mechanism is pulled vertically downward, a corresponding horizontally extending rod disengages a corresponding upturned distal end of one of said extending arms, allowing said arm to transition from said second position to said first position.

* * * * *